US007812742B2

(12) United States Patent
Pankowski

(10) Patent No.: US 7,812,742 B2
(45) Date of Patent: Oct. 12, 2010

(54) VEHICLE POSITIONING GUIDE AND METHOD

(76) Inventor: Joseph Michael Pankowski, 2644 Nantucket Ln, Tallahassee, FL (US) 32309-2246

( * ) Notice: Subject to any disclaimer, the term of this patent is extended or adjusted under 35 U.S.C. 154(b) by 382 days.

(21) Appl. No.: 12/029,599

(22) Filed: Feb. 12, 2008

(65) Prior Publication Data

US 2009/0201175 A1 Aug. 13, 2009

(51) Int. Cl.
*B60Q 1/48* (2006.01)

(52) U.S. Cl. ..... 340/932.2; 362/511; 116/28 R

(58) Field of Classification Search ..... 340/932.2; 362/511; 116/28 R
See application file for complete search history.

(56) References Cited

U.S. PATENT DOCUMENTS 3,998,285 A * 12/1976 Cooper ..... 280/762
5,406,395 A * 4/1995 Wilson et al. ..... 359/15
5,617,087 A * 4/1997 Scott ..... 340/932.2
6,191,706 B1 * 2/2001 Kositkun ..... 340/932.2
2005/0047164 A1 * 3/2005 Houston ..... 362/511

* cited by examiner

*Primary Examiner*—George A Bugg
*Assistant Examiner*—Bradley E Thompson

(57) ABSTRACT

In accordance with the present invention, there are provided three bars of light to help a user maneuver a vehicle into a space accessed by a garage door that is controlled by an electric door opener. The three bars of light are powered by an electric garage door opener using one of the two electric lamp outputs of the garage door opener. A simple screw-in plug base and triple tap adapter allows one outlet to power the three bars of light. When a vehicle approaches the garage and signals for the garage door to open the three bars of light are activated. The driver of the vehicle need only keep the center bar of light centered between the outside bars of light to properly align the vehicle.

2 Claims, 6 Drawing Sheets

VEHICLE POSITIONING GUIDE AND METHOD

CROSS-REFERENCE TO RELATED APPLICATIONS

Not applicable

FEDERALLY SPONSORED RESEARCH

Not applicable

SEQUENCE LISTING OR PROGRAM

Not applicable

BACKGROUND

1. Field of Invention

Figure 1:
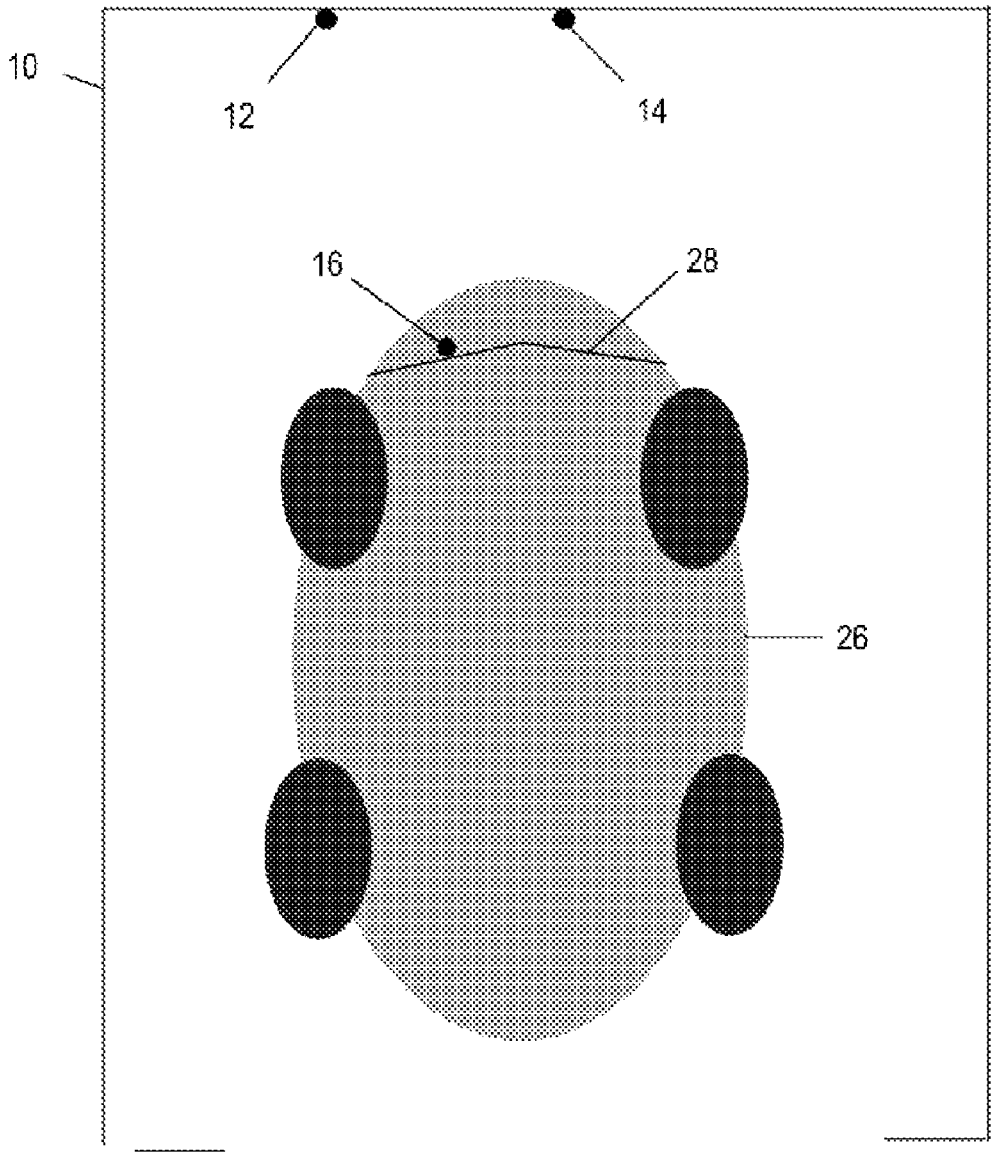

The present invention relates to precision parking and, more particularly, to parking a vehicle into an optimal parking position within a parking space by visually centering one middle bar of light between two others.

2. Prior Art

The process of parking a vehicle in a garage is becoming more difficult. Originally designed for storage of vehicles, many people now find the room a convenient one for other stuff. Often items competing with the vehicle include bicycles, lawn mowers, ping-pong tables, fishing gear, holiday decorations and outdoor grills. In addition, a problem often surfaces with the width of vehicles increased due to large outside rearview mirrors. On occasion these mirrors have been damaged as drivers tried to park their vehicles through narrow garage doors. Other damage has occurred as a result of vehicles hitting bicycles or ping-pong tables. This has resulted in some drivers merely leaving their vehicles parked outside to avoid the problems of precise positioning when entering the garage.

Many attempts have been made to provide devices which enable a driver of a vehicle to precisely align and position a vehicle within a garage.

Examples include:

U.S. Pat. No. 3,874,322, issued to Brauer on Apr. 1, 1975, is a movable vehicle parking position indicator which moves in conjunction with a garage door used to close off the parking area. As the garage door is opened, a ball-like indicator is lowered into a position clearly visible from the driver position of a vehicle entering or properly parked in the garage. As the door is closed, the indicator is retracted. No assistance is given to the driver of the vehicle in proper aligning for entry into the garage.

U.S. Pat. No. 3,998,285, issued to Cooper on Dec. 21, 1976, is a vehicle indicating mechanism, in the form of a parking guide, which gauges the back clearance of an automobile or similar vehicle. The parking guide includes a hollow, translucent guide rod, which is movable responsive to a motor within a control box, from a substantially horizontal position, adjacent to the back bumper of the vehicle, to a substantially vertical position, extending upwardly from the corner of the bumper. The guide rod is illuminated by a light within the control box when the rod is in the vertical position thereby also enabling the rod to be viewed by the driver and used as a guide for parking the automobile at night. No assistance is offered in terms of aligning the vehicle.

U.S. Pat. No. 4,145,681, issued to Bubnich on Mar. 20, 1979, is a parking guide and signaling device for cars and trucks to assist the driver parking a vehicle in a designated parking area which includes a housing section having a window in the front wall thereof which is closed by a pane of translucent sheet material through which indicia can be seen clearly when the indicia are illuminated from the rear surface of the pane by an electric light with electrical apparatus within the housing for illuminating the pane and the housing section having pivotally mounted thereon an actuating lever biased so that the electrical apparatus is normally "off" but when the vehicle moves into a designated parking area the electrical apparatus is turned "on" and an intense beam of light illuminates the inner surface of the pane. No alignment assistance is provided to the driver of the vehicle U.S. Pat. No. 4,218,157, issued to Moxness on Aug. 19, 1980, consists of a visual vehicular parking aid which includes a plurality of vertically suspended position indicators to direct a person driving an automobile into a parking space when the normal pavement markings are not visible or present. This parking space marker system does help insure the vehicle is in a designated space, but provides no advance assistance in properly aligning a vehicle as it approaches the parking space.

U.S. Pat. No. 4,257,706, issued to Smith, Mar. 24, 1981, describes a motor vehicle back-up limit gauging method and apparatus. This apparatus enables a driver of a vehicle to gauge distances when backing-up. The apparatus includes a pair of sights which are attached to the vehicle. These sights are then used by aligning them with the ground line of a wall or with another marker. Alignment is accomplished by viewing the sights through a side-view mirror. This apparatus has several drawbacks. It is only useful when a vehicle is being driven in reverse. It requires additional structure to be added to the side of a vehicle. It also requires training and skill to use.

U.S. Pat. No. 4,808,997, issued to Barkley on Feb. 28, 1989, consists of a photoelectric vehicle position indicating device which is for use in parking and otherwise positioning vehicles and is employed to assist in parking and otherwise positioning a vehicle on a supporting surface. A photoelectric control unit is mounted on an overhead structure spaced above the supporting surface and has a beam emitting device for directing a light beam downwardly for interception by the vehicle. The light beam is initially reflected back to a photoelectric transducer on the control unit by a reflective device or mirror. The light beam is pulsed so that the transducer supplies electrical pulses to an amplifier that is correspondingly gated. When the vehicle interrupts the light beam, the amplifier produces a beam interruption output signal which causes a one-shot timer to energize an alarm device, through an output relay. The operator then stops the vehicle in the desired position. The one-shot timer de-energizes the alarm device after a brief interval. Alternatively, the mirror is not employed, and the light beam is not significantly reflected back to the transducer until the light beam is intercepted by the vehicle, whereupon reflection from the vehicle produces a reflected light beam to the transducer. The corresponding pulsed signals from the transducer operate the amplifier, which is modified so that it actuates the timer, whereby it energizes the alarm device for a timed interval. The device allows for positioning in terms of how far the vehicle is allowed to enter the desired parking space but does not precisely provide aligning assistance.

U.S. Pat. No. 4,813,758, issued to Sanders Mar. 21, 1989, is a guide that enables a driver to position a vehicle within a garage. The guide is positioned at an end wall of a garage so that it faces the garage door. It comprises lateral positioning members and a longitudinal positioning member. The lateral positioning members comprise lateral positioners which are offset from each other. Alignment of the lateral positioning members indicates that the operator of a vehicle is in the correct lateral position within a garage. Longitudinal alignment is indicated by the reflection of a headlight in a driver's eyes. This guide provides very limited alignment assistance to the driver of a vehicle prior to entering the garage. The alignment depends upon reflections of the headlights requiring them to be activated even during the day.

U.S. Pat. No. 4,965,571 issued to Jones on Oct. 22, 1990, is a motor vehicle driver-indicator guide-device for signifying when it is safe to advance including a support structure mounting a light signaling structure and mechanism therefore, that displays a signal light viewable by a driver of a motor vehicle with an actuating lever which the bumper actuates. A green light of the light signaling structure has an electrical circuitry and an electrical switch that is normally closed providing a go signal evidencing that further advancement of the motor vehicle may be continued, actuation of the actuating lever serving to open the normally closed electrical switch when the actuation switch is pressed beyond a predetermined position indicative of maximum allowable forward advancement permissible for the advancing motor vehicle, the support structure having a tape mounted thereon carrying an adhesive backing for mounting the mounting structure on an upright surface of a wall or the like, the green light carrying a symbol viewable when the switch is closed indicative of permissive further advancement. A major problem with this device is that no assistance is offered in aligning the vehicle properly in the garage.

U.S. Pat. No. 5,177,479, issued to Cotton on Jan. 5, 1993, is a garage parking position indicator which is operable on principles of wave energy. A wave energy detector such as an infrared receiver is mounted to one side of the garage access door at a point displaced from the rear wall of the garage by a distance greater than the length of the vehicle. A wave energy source, such as an infrared transmitter, is mounted on the opposite side of the garage access door from the receiver. The transmitter and the receiver are mounted at a height suitable for cross-sectioning the traveling vehicle from this leading edge to its trailing edge, preferably from bumper to bumper. The transmitter constantly transmits and directs wave energy toward the receiver so that the presence of any portion of the vehicle between the transmitter and the receiver will interrupt reception of the wave energy by the receiver. No alignment assistance is provided to the driver of the vehicle.

U.S. Pat. No. 5,189,802, issued to Bergfield on Mar. 2, 1993, is a vehicle parking guide that comprises a rotary mechanical arm which is attached to a string. As a bumper of a vehicle encroaches upon the string, the arm rotates to indicate relative positioning of the vehicle. This guide does not assist in the alignment of the vehicle when the vehicle is approaching the garage.

U.S. Pat. No. 5,127,357, issued to Viscovich on Jul. 7, 1992, utilizes a mirror mounted on a surface in a garage to reflect light to the side rear-view mirror on a vehicle. The invention operates by reflecting the illuminated brake lights into the side rear-view mirror when the vehicle is properly positioned. The shortcomings of this invention involve requiring the driver's attention to be focused on the rear-view mirror, thus distracting the driver from other pertinent surroundings. In addition, the tolerance of proper positioning is inherently large as the mirrors will reflect all incident light and the driver must judge the magnitude or intensity of the reflected light in order to properly position a vehicle. This could lead to imprecise positioning of the vehicle.

U.S. Pat. No. 5,227,785, issued to Gann on Jul. 13, 1993, is a vehicle parking assist apparatus which includes a hollow mounting base, an elongated signaling device, such as an upright pole having a signal light mounted thereto, supported on the base for pivotal movement from a normal upright non-signaling position to a tilted signaling position upon being contacted by an advancing vehicle, and an electrical circuit connected to the signal light of the elongated signaling device and capable of being switched from an open circuit condition to a closed circuit condition for electrically actuating the signal light to provide a visible alerting signal for a driver of the advancing vehicle. A coupling device supports the pole upright on the base and also couples the signal light to the electrical circuit. The coupling device is capable of retaining the electrical circuit in an open circuit condition so long as the signaling device is disposed in the upright non-signaling position. The coupling device is further capable of switching the electrical circuit to the closed circuit condition in response to the elongated signaling device being contacted and tilted by the advancing vehicle to the tilted signaling position. No assistance is provided in vehicle alignment.

U.S. Pat. No. 5,285,205, issued to White on Feb. 8, 1994 is a vehicle-guidance and positioning system. The system utilizes a laser. The emitted beam from the laser is directed over the path along which a vehicle is to be guided. The laser beam impinges on a target area located on the vehicle in such a manner that the impingement of the laser beam on the target is continuously observable by the vehicle's operator. The operator steers the vehicle so that the laser beam continuously impinges on the target area until the vehicle reaches a preselected position. One problem with this system is the narrow and hard to see path that is provided by the laser light. In inclement weather, rain or snow, the laser light could be impacted on the target and thus be hard to see and would direct attention away from obstacles directly ahead of the vehicle.

U.S. Pat. No. 5,406,395, issued to Wilson on Apr. 11, 1995, is an optical parking alignment system which includes at least one projector located on a vehicle for projecting a respective image forwardly of the vehicle. The alignment of the vehicle is indicated when each respective image is in focus on a screen disposed in front of the vehicle. The projector includes either a transparency and an imaging lens or a hologram and a narrow-band light source. This is a fairly complex system and assistance provided for alignment is minimal at best.

U.S. Pat. No. 5,617,087, issued to Scott on Apr. 1, 1997, is a parking device for vehicles entering a ceiling-covered parking garage which includes a housing. The housing substantially encloses an electrical circuit. The electrical circuit includes a light-emitting bulb and a switch. The switch opens and closes the electrical circuit to light and shut off the bulb. A power supply and a cord suspend the housing from the ceiling of the parking garage so that the housing may intercept the vehicle to be parked, close the switch of the circuit, thereby emitting a light signal to the driver of the vehicle to let the driver know that the vehicle has reached the predetermined parking position. This parking aid helps place the vehicle in a predetermined position; however no assistance in alignment is provided.

U.S. Pat. No. 5,841,368, issued to Bryant on Nov. 24, 1998, consists of a parking assist device which is removable affixed in relation to a surface and is adapted to engage the on coming wheels of a vehicle and provide upon being engaged by the wheels of a vehicle a signal to the operator to stop the vehicle. The signal may be produced by either a mechanical mechanism or an electrical apparatus. Again, no assistance is offered in aligning the vehicle properly in the garage.

U.S. Pat. No. 5,945,907, issued to Yaron on Aug. 31, 1999, is a sensing and indicating device mounted at a fixed location to determine the distance between the sensor and an approaching vehicle. The sensor provides visual and/or audible indication of the distance between the vehicle and the sensor. The driver of the vehicle uses that displayed or audible information to locate the vehicle within a defined space or envelope, e.g., within a garage. The sensor and indicator may also be located laterally with respect to the vehicle so that the distance between the vehicle side and the sensor can be determined whereby the vehicle can be located laterally within the defined space or envelope. Once more, no assistance is offered in aligning the vehicle properly in the garage.

U.S. Pat. No. 6,199,287, issued to Rankila on Mar. 13, 2001, is a device for positioning a vehicle in a predetermined location. This device is comprised of two spatially separated but conjoined planar surfaces, the first of which is mounted on a wall and the second is extended toward the driver. While this device will assist the driver in positioning the vehicle when the second planar surface is aligned with and obscures a portion of the first planar surface, it has several drawbacks. In its rigid form, the device actually provides another obstruction that could cause damage to a vehicle because the distance required to separate the first and second surfaces must be of more than negligible in order for this device to operate properly (too short of a distance would provide too great of a tolerance in the desired parking position). In its retractable embodiment, the device would require a driver to exit the vehicle in order to reset the device into its operable position before attempting to position the vehicle. This is extremely inconvenient to the driver. Finally this device requires the driver's attention to be focused on the device and not on the pertinent surroundings in the parking space. This lack of attention on the pertinent surroundings could cause more extensive damage than what the device is attempting to correct.

U.S. Pat. No. 6,776,117, issued to D'Onofrio on Aug. 17, 2004, utilizes the peripheral vision of a driver of a vehicle in assessing the proper position of a vehicle relative to a confined parking space. The device is comprised of two surfaces, the first obscuring the second until the vehicle has attained the desired position within the parking space. Upon attaining this position, the second surface comes within the operator's field of vision thus notifying the operator to stop the vehicle. Alternately, the operator will stop the vehicle when the second surface obscures the first surface. This device requires the use of peripheral vision, careful attention to details and requires the driver to divert attention from the front of the vehicle which could cause an impact with obstacles in front.

The complexity of other solutions involving parallel vertical and horizontal bars, mirrors, pulleys, strings, breaking lights, rotating arms, alarm devices, and actuating cords, as well as the apparent difficulty of installing them properly, has not proven them in many instances acceptable to marketing. All of the previous attempts do not adequately solve the vehicle positioning problem. Thus, what is needed is a device and method for using that device that 1) is easily understood, 2.) requires little orientation or training in operation, 3) positions the vehicle precisely within a confined parking space, 4) operates automatically with the opening of the garage door, and 5) turns off automatically at the end of its assistance.

SUMMARY

In accordance with the present invention, there are provided three bars of light to help a user maneuver a vehicle into a space accessed by a garage door that is controlled by an electric door opener. The three bars of light are powered by an electric garage door opener using one of the two electric lamp outputs of the garage door opener. A simple screw-in plug base and triple tap adapter allows one outlet to power the three bars of light. When a vehicle approaches the garage and signals for the garage door to open the three bars of light are activated. The driver of the vehicle need only keep the center bar of light centered between the outside bars of light to properly align the vehicle. Once inside the parking space the system turns off automatically when the garage door opener turns off.

DRAWINGS

Figures

FIG. 1 is a top view of a garage with the three bars of light and a vehicle properly aligned.

Figure 2:
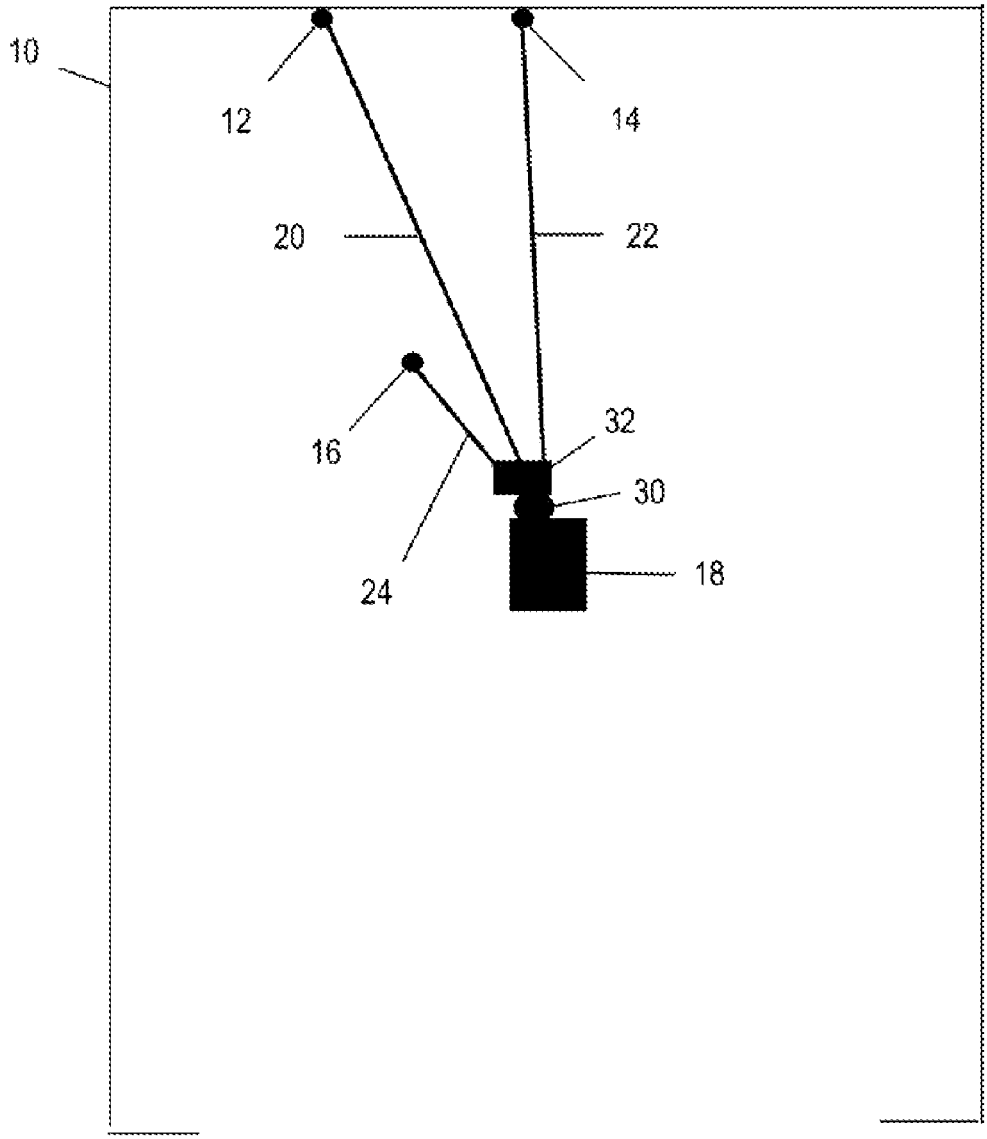
Figure 3:
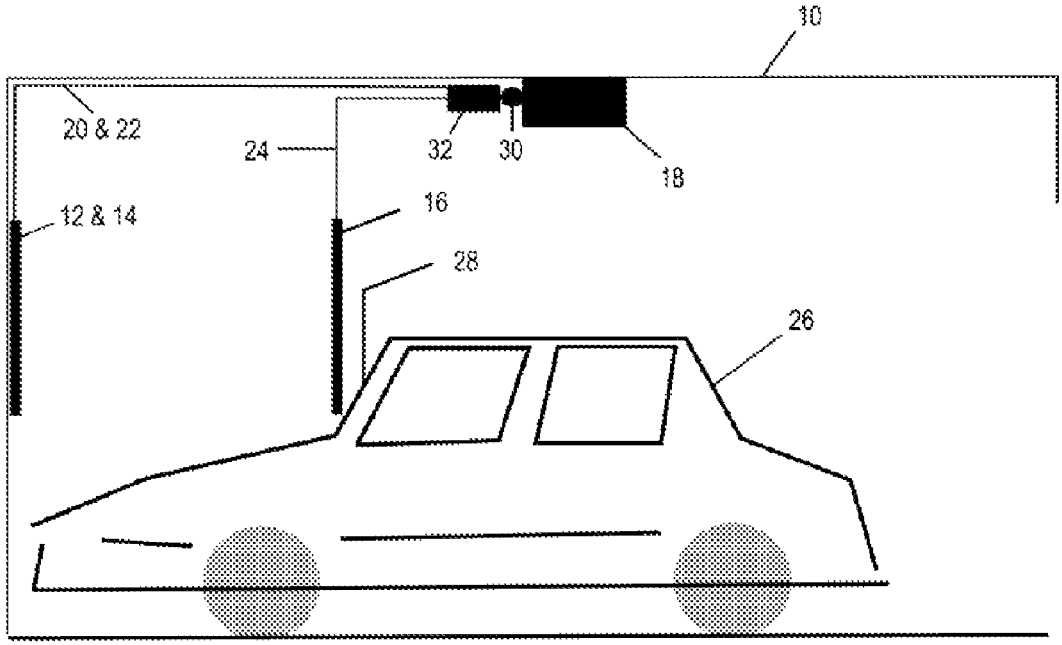

FIG. 2 is a top view of a garage with the left bar of light, the right bar of light and the center bar of light. Also shown are the garage door opener and the three connecting electric power lines consisting of the left power line, the right power line and the center power line FIG. 3 is a left view of a garage with a vehicle, a left bar of light, a right bar of light a center bar of light and the garage door opener.

Figure 4:
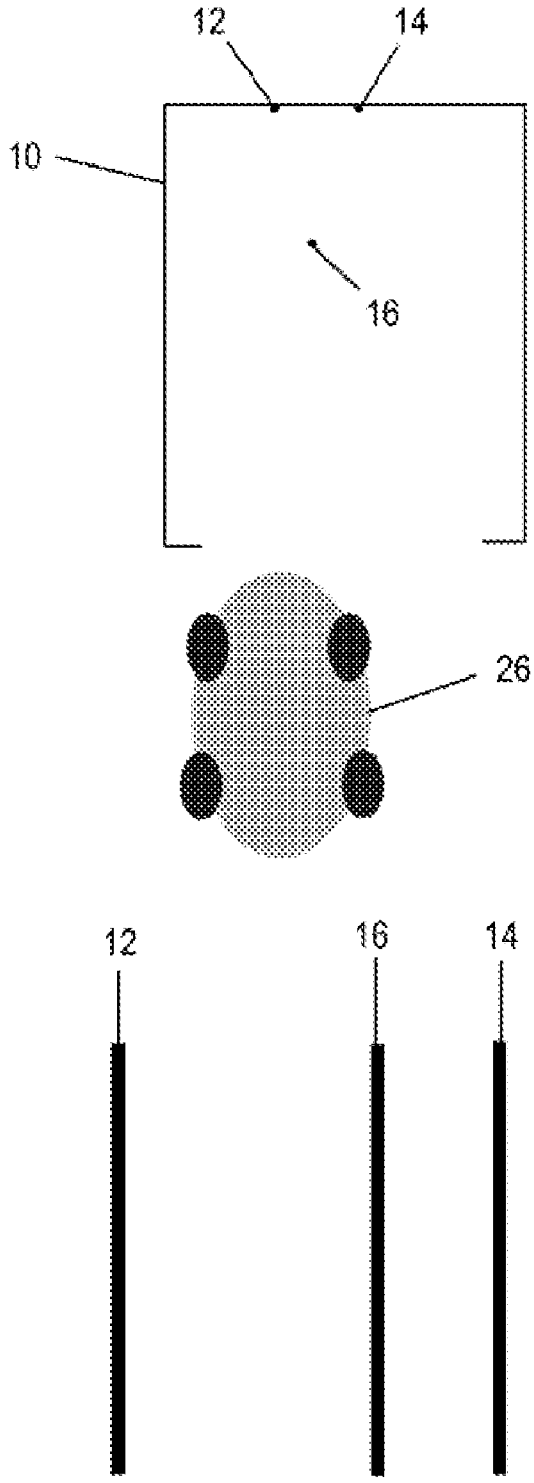

FIG. 4 is a top view of a garage with a vehicle too far to the left as it approaches the garage opening. Below the vehicle is a depiction of the bars of light that the driver of the vehicle would see ahead through the windshield in this instance.

Figure 5:
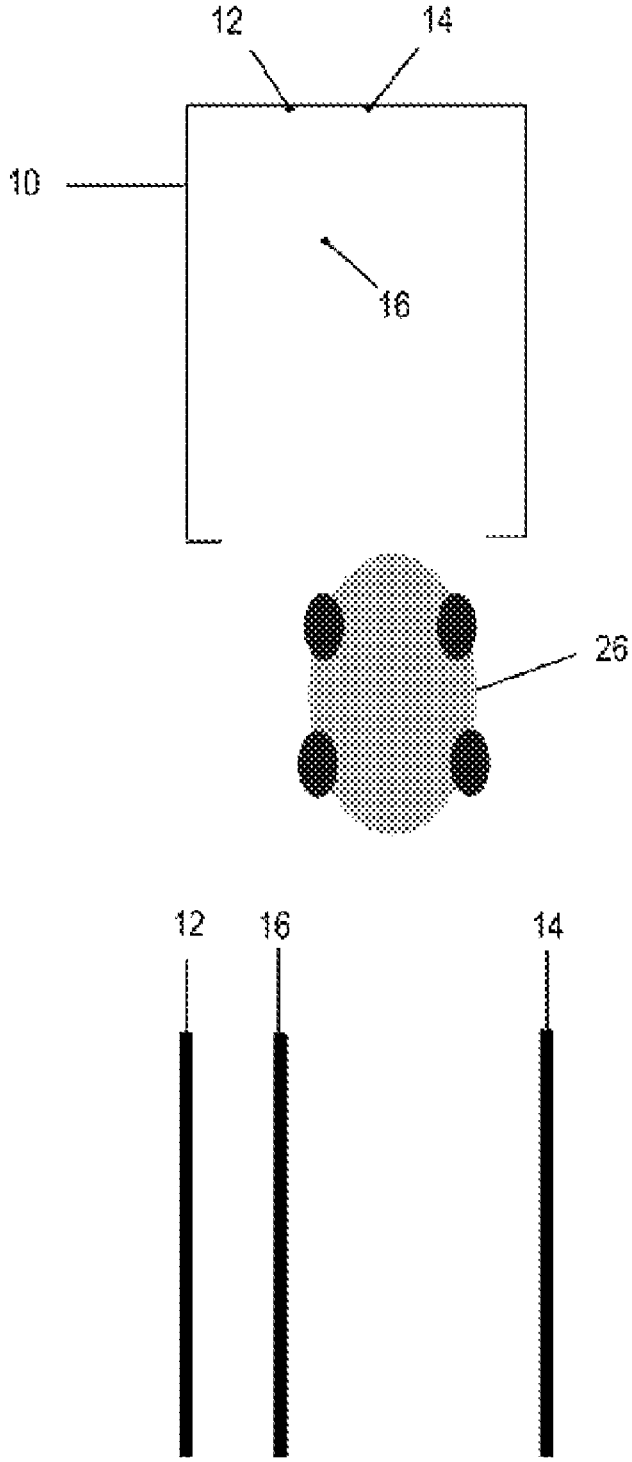
Figure 6:
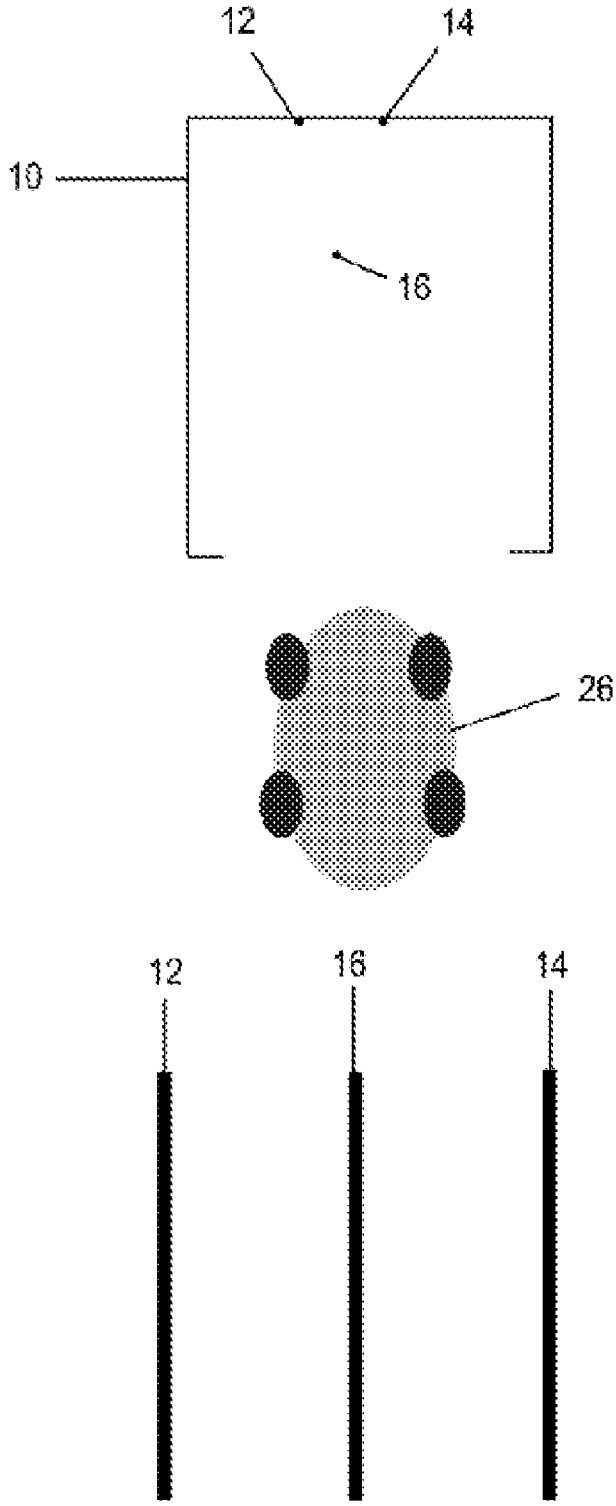

FIG. 5 is a top view of a garage with a vehicle too far to the right as it approaches the garage opening. Below the vehicle is a depiction of the bars of light that the driver of the vehicle would see ahead through the windshield in this instance FIG. 6 is a top view of a garage with a vehicle right on course as it approaches the garage opening. Below the vehicle is a depiction of the bars of light that the driver of the vehicle would see ahead through the windshield in this instance.

DETAILED DESCRIPTION

FIG. 1 is a top view of a garage 10 with the three bars of light. The garage 10 has an opening in the lower portion of the outline where a vehicle 26 may enter. The garage 10 door opening would typically have a garage 10 door which opens and closes to allow access to the garage 10; however this is not shown here for simplicity.

Also, in order to present this idea as simply as possible, only one garage 10 is outlined, but the idea is also appropriate for garages with two or more parking areas. The three bars of light, when properly aligned, allow a vehicle 26 entering the garage 10 to be placed in a predetermined position. In addition, the center bar of light 16 may be positioned in such a way to touch the front windshield 28 of the vehicle 26 upon arrival in the final stopping position. The bars of light may be purchased commercially in several ways. One possible bar of light is the Portfolio 30 Inch Incandescent Accent Strip distributed by Good Earth Lighting, Inc and available at Lowe's Home Centers. This product may be used for all three bars of light. Another possible source for the bar of light is the Super Bright Rope Light Kit distributed by Home Depot U.S.A., Inc. The right bar of light 14 and the left bar of light 12 are attached to the back wall of the garage 10. The center bar of light 16 is attached to hang from the garage 10 ceiling at a location that allows the bar of light to touch the windshield 28 of the vehicle 26 when the vehicle 26 is in the predetermined position.

FIG. 2 is a top view of a garage 10 with the left bar of light 12, the right bar of light 14 and the center bar of light 16. Also shown are the garage door opener 18 and the three connecting electric power lines consisting of the left power line 20, the right power line 22 and the center power line 24. The garage door opener 18 may be any one of several commercially available door openers provided it has a light bulb socket to allow a plug base 30 to be screwed in to power the three bars of light. The three power lines are common extension cords. The three power lines are plugged into the triple tap adapter 32. The triple tap adapter 32 is plugged into the plug base 30. The plug base 30 is screwed into one of the light sockets of the garage door opener 18. The right bar of light 14 is powered by the right power line 22. The left bar of light 12 is powered by the left power line 20. The center bar of light 16 is powered by the center power line 24. Both the plug base 30 and the triple tap adapter 32 are available at Ace Hardware.

FIG. 3 is a left view of a garage 10 with a vehicle 26, a left bar of light 12, a right bar of light 14 and a center bar of light 16. Note that the right bar of light 14 is hidden from view in FIG. 3 by the left bar of light 12. The right power line 22 is also hidden from view by the left power line 20. The bars of light and power lines are secured to the ceiling and walls of the garage 10 with staples. The windshield 28 of the vehicle 26 is shown almost touching the center bar of light 16 indicating that the vehicle is in the proper position in terms of forward placement. The proper alignment is not shown in this figure. That will be demonstrated in the remaining three figures.

FIG. 4 is a top view of a garage 10 with a vehicle 26 too far to the left as it approaches the garage 10 opening. Below the vehicle 26 is a depiction of the bars of light that the driver of the vehicle 26 would see ahead through the windshield 28 in this instance. Note that the center bar of light 16 is not centered and appears much closer to the right bar of light 14. The driver knows that to correct the course it is necessary to turn the steering wheel in the direction of the center bar of light 16. This will correct the course and when the center bar of light 16 appears midway between the right bar of light 14 and the left bar of light 12 the vehicle 26 is on the proper course.

FIG. 5 is a top view of a garage 10 with a vehicle 26 too far to the right as it approaches the garage 10 opening. Below the vehicle 26 is a depiction of the bars of light that the driver of the vehicle 26 would see ahead through the windshield 28 in this instance. Note that the center bar of light 16 is not centered and appears much closer to the left bar of light 12. The driver knows that to correct the course it is necessary to turn the steering wheel in the direction of the center bar of light 16. This will correct the course and when the center bar of light 16 appears midway between the right bar of light 14 and the left bar of light 12 the vehicle 26 is on the proper course.

FIG. 6 is a top view of a garage 10 with a vehicle 26 right on course as it approaches the garage 10 opening. Below the vehicle 26 is a depiction of the bars of light that the driver of the vehicle 26 would see ahead through the windshield 28 in this instance. Note that the center bar of light 16 is properly centered. The driver knows that to continue toward the proper alignment position in the garage 10 it is only necessary to keep the center bar of light 16 midway between the right bar of light 14 and the left bar of light 12 until the center bar of light 16 touches the windshield 28 of the vehicle 26.

I claim:

1. A vehicle positioning guide and method for guiding a vehicle into a position within a parking space using a guidance positioning arrangement: Wherein there is a left bar of light attached to the rear wall of a garage; a right bar of light attached to the rear wall of a garage; a center bar of light attached to the ceiling of a garage; a left power line attached to the left bar of light; a right power line attached to the right bar of light; a center power line attached to the center bar of light; a triple tap adapter attached to the left power line, the right power line and the center power line; a plug base attached to the triple tap adapter; a plug base attached to an electric outlet on a automatic garage opener; and a garage door opener with remote control.

2. The method of positioning the vehicle in a designated parking position comprises the steps of: approaching a garage in a vehicle; signaling the garage door to open using a remote control device; aligning the center bar of light directly in the center of the right bar of light and the left bar of light, as seen through the windshield while approaching the garage opening; stopping the vehicle when the center bar of light touches the windshield of the vehicle.

* * * * *